US008091811B2

(12) United States Patent
Yang

(10) Patent No.: US 8,091,811 B2
(45) Date of Patent: Jan. 10, 2012

(54) APPARATUS FOR COLLECTING, PROCESSING, AND RECYCLING KITCHEN SCRAPS

(76) Inventor: Chen Yang, Taipei (TW)

( * ) Notice: Subject to any disclaimer, the term of this patent is extended or adjusted under 35 U.S.C. 154(b) by 199 days.

(21) Appl. No.: 12/573,160

(22) Filed: Oct. 5, 2009

(65) Prior Publication Data

US 2011/0079669 A1 Apr. 7, 2011

(51) Int. Cl.
*B02C 19/00* (2006.01)

(52) U.S. Cl. ..... 241/38; 241/46.017; 241/101.2; 241/138

(58) Field of Classification Search ..... 241/101.2, 241/38, 46.017, 138
See application file for complete search history.

(56) References Cited

U.S. PATENT DOCUMENTS

| | | | | |
|---|---|---|---|---|
| 2,414,949 | A * | 1/1947 | Hirshstein | 138/46 |
| 3,371,871 | A * | 3/1968 | Shepherd | 241/43 |
| 3,695,520 | A * | 10/1972 | Mauro | 241/43 |
| 5,934,576 | A * | 8/1999 | Robinette | 241/15 |
| 7,374,669 | B2 * | 5/2008 | Zinn | 210/138 |

* cited by examiner

*Primary Examiner* — Mark Rosenbaum

(57) ABSTRACT

An apparatus for collecting, processing, and recycling kitchen scraps is provided. Kitchen scraps are thrown into a throw-in conduit provided on each floor of a building and transferred to a delivery conduit by a flushing device so as to reach a kitchen scraps collection device and be processed thereby. After the kitchen scraps are processed by the kitchen scraps collection device, a liquid removed from the kitchen scraps is further processed by a grease interception device so that oil is separated from the liquid. Thus, the apparatus collects, processes collectively, and performs water/oil separation on kitchen scraps.

1 Claim, 7 Drawing Sheets

APPARATUS FOR COLLECTING, PROCESSING, AND RECYCLING KITCHEN SCRAPS

BACKGROUND OF THE INVENTION

1. Technical Field

The present invention relates to an apparatus for collecting, processing, and recycling kitchen scraps and, more particularly, to an apparatus configured for recycling and processing kitchen scraps collectively.

2. Description of Related Art

Presently, kitchen scraps are usually treated as ordinary waste and thrown into a waste disposer. The waste disposer shreds the kitchen scraps and discharges the shredded kitchen scraps to a sewer along with added water. As oil and grease in the kitchen scraps are also discharged to the sewer through pipes, the pipes tend to clog, and the environment may be polluted. A more environment-friendly approach is to have kitchen scraps stored in collection bins placed at fixed collection points so that the kitchen scraps can be subsequently used to make compost or be discharged after water/oil separation. However, as kitchen scraps are transported through public facilities or public spaces, pollution is likely to occur. Furthermore, if stored in the collection bins for an excessively long time, kitchen scraps will undergo fermentation, produce unpleasant odor, attract mosquitoes and flies, and thereby pollute the surroundings. Besides, the oil and grease in kitchen scraps are also a big problem. Since grease interception devices are only used in large restaurants nowadays, household kitchen scraps are directly discharged without grease interception and therefore become a source of pollution in communities. Hence, it is of environmental importance to provide an easy and convenient way to collect and recycle kitchen scraps and separate the water and oil contained therein.

BRIEF SUMMARY OF THE INVENTION

It is a primary objective of the present invention to provide an apparatus for collecting, processing, and recycling kitchen scraps, such that kitchen scraps thrown into a throw-in conduit on each floor of a building are transferred to a delivery conduit by a flushing device so as to reach a kitchen scraps collection device and be processed thereby. Thus, kitchen scraps are collected and then processed collectively.

It is a secondary objective of the present invention to provide an apparatus for collecting, processing, and recycling kitchen scraps, wherein a kitchen scraps collection device is connected with a large grease interception device. The kitchen scraps collection device processes kitchen scraps and removes a liquid therefrom. Then, water and oil in the liquid are separated by the grease interception device. After the oil is collected, the water is discharged to a sewer in favor of environmental protection.

BRIEF DESCRIPTION OF THE SEVERAL VIEWS OF THE DRAWINGS

The invention as well as a preferred mode of use, further objectives, and advantages thereof will be best understood by referring to the following detailed description of an illustrative embodiment in conjunction with the accompanying drawings, in which.

DETAILED DESCRIPTION OF THE INVENTION

Figure 1:
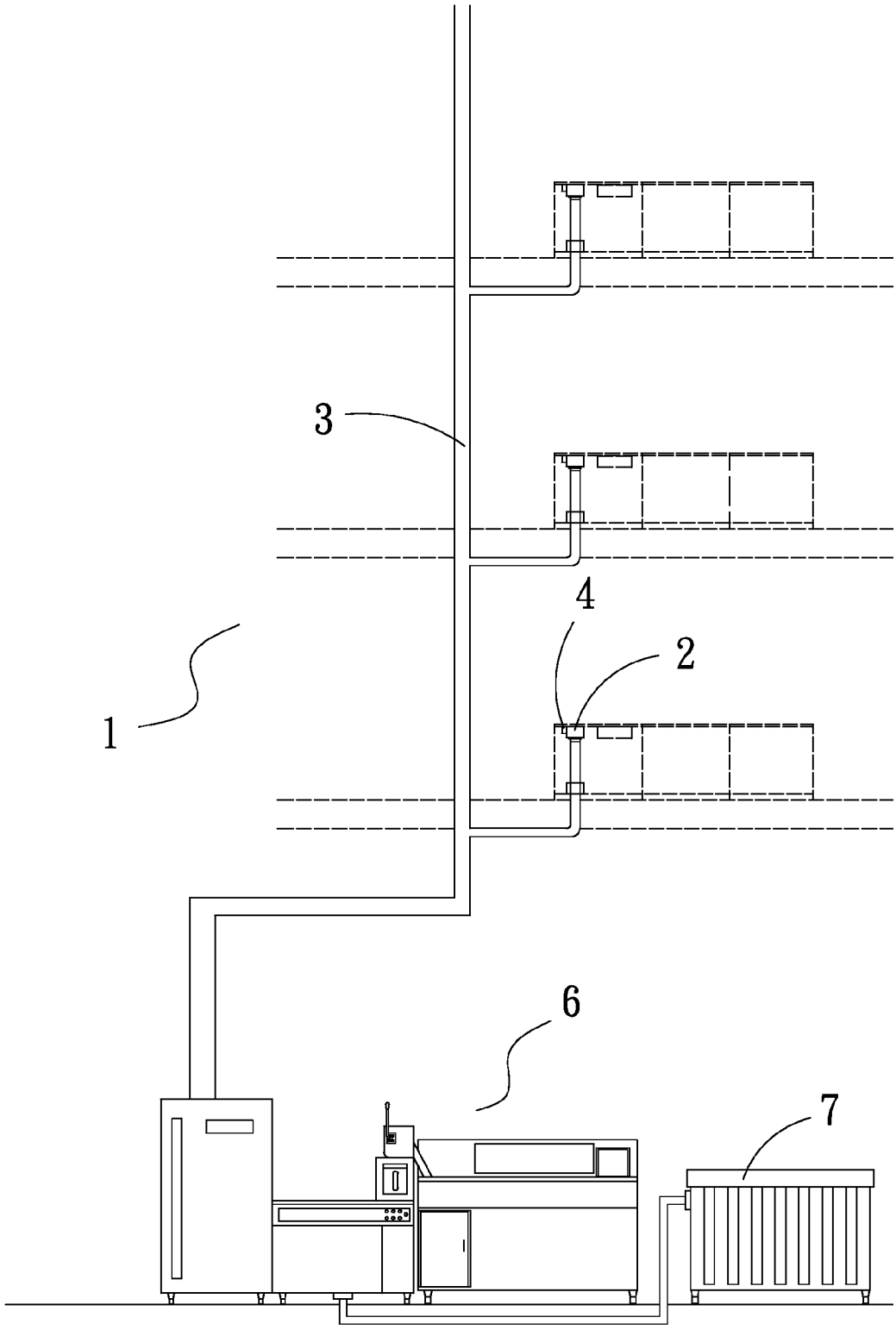
FIG. 1 is a schematic view of an apparatus for collecting, processing, and recycling kitchen scraps according to the present invention.
Figure 2:
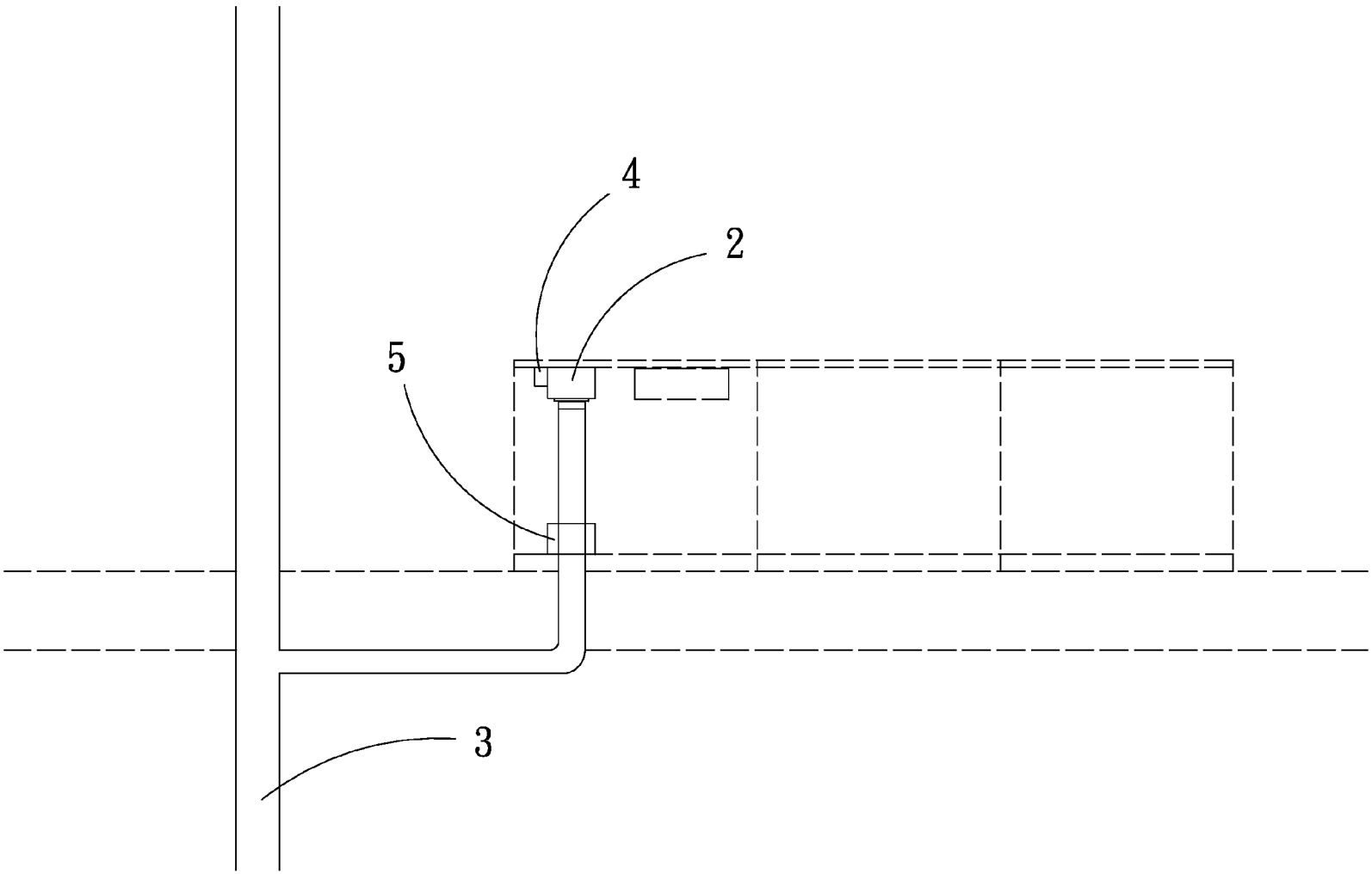
FIG. 2 is a partial schematic view of the apparatus according to the present invention.
Figure 3:
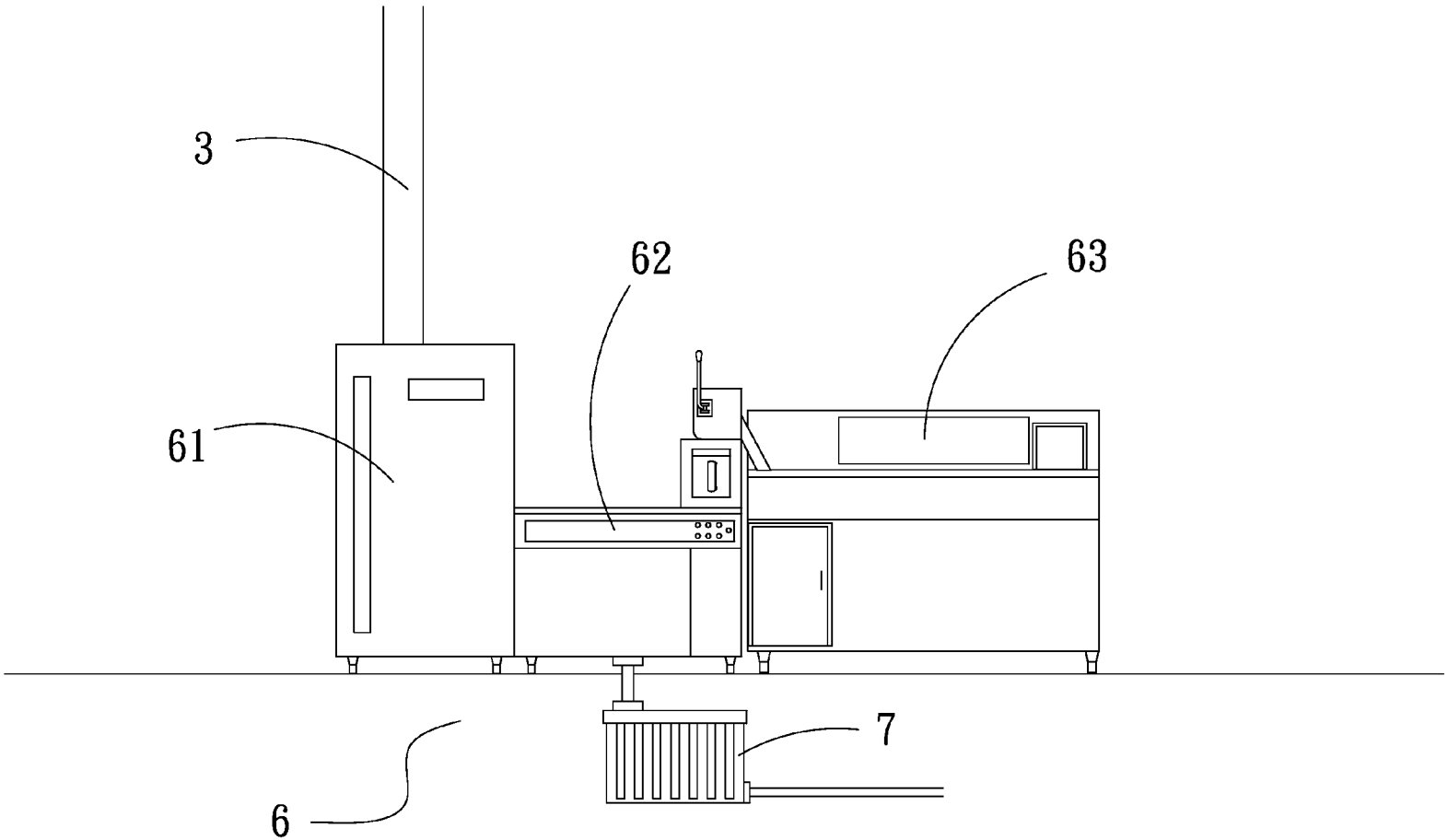
FIG. 3 is another partial schematic view of the apparatus according to the present invention.
Figure 4:
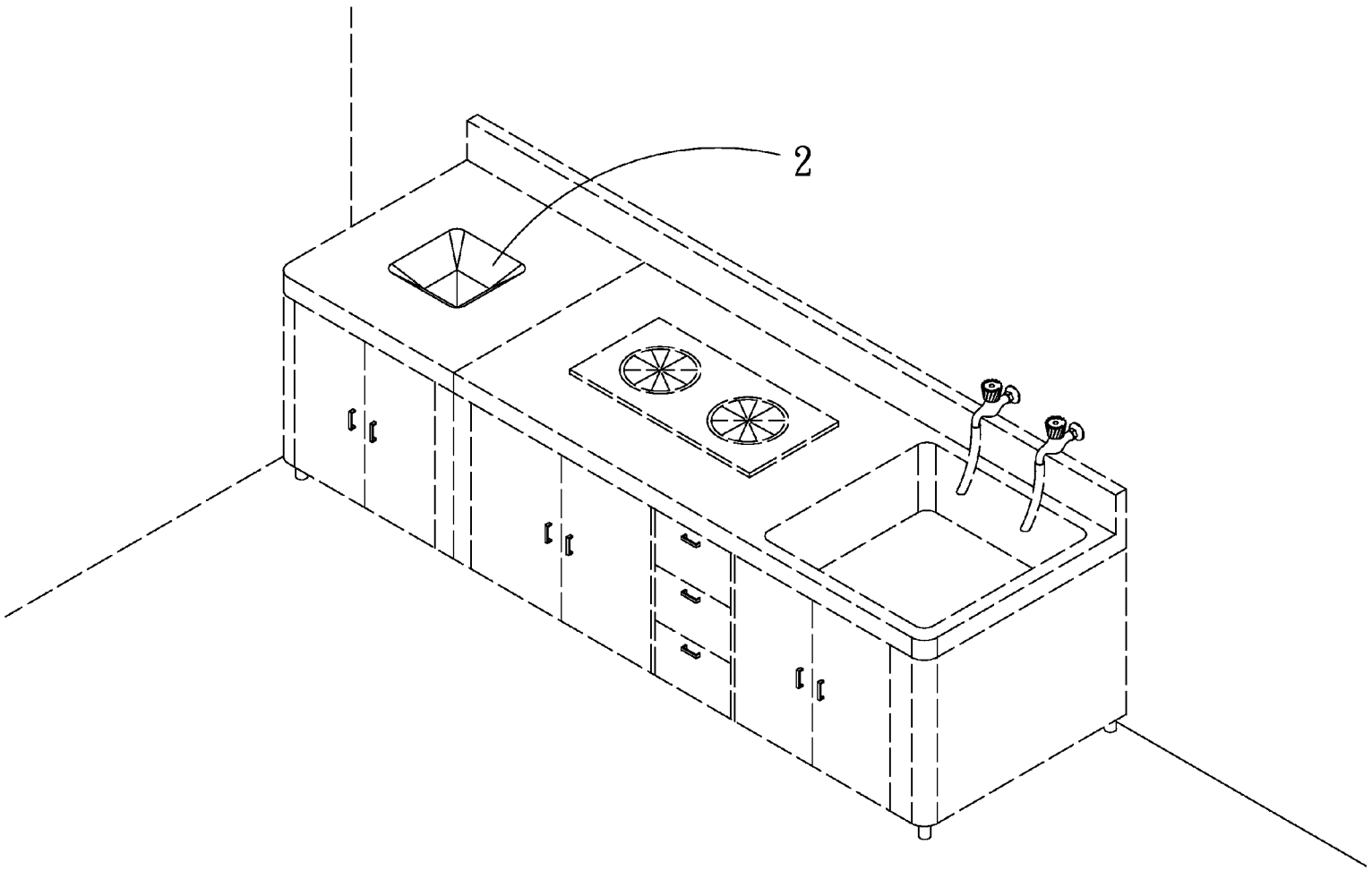
FIG. 4 is a perspective view of a preferred embodiment of the present invention.
Figure 5:
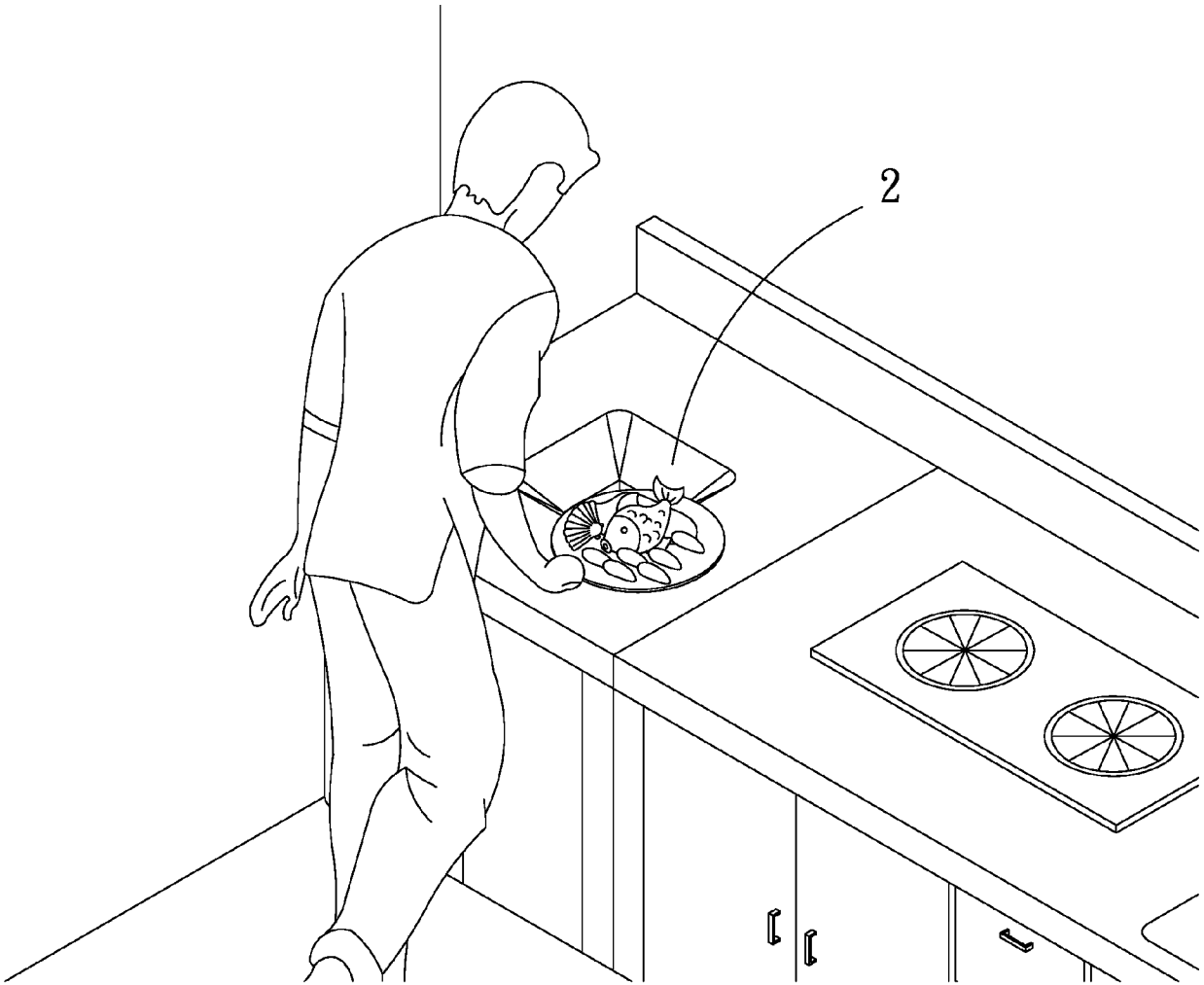
FIG. 5 is another perspective view of the preferred embodiment of the present invention.
Figure 6:
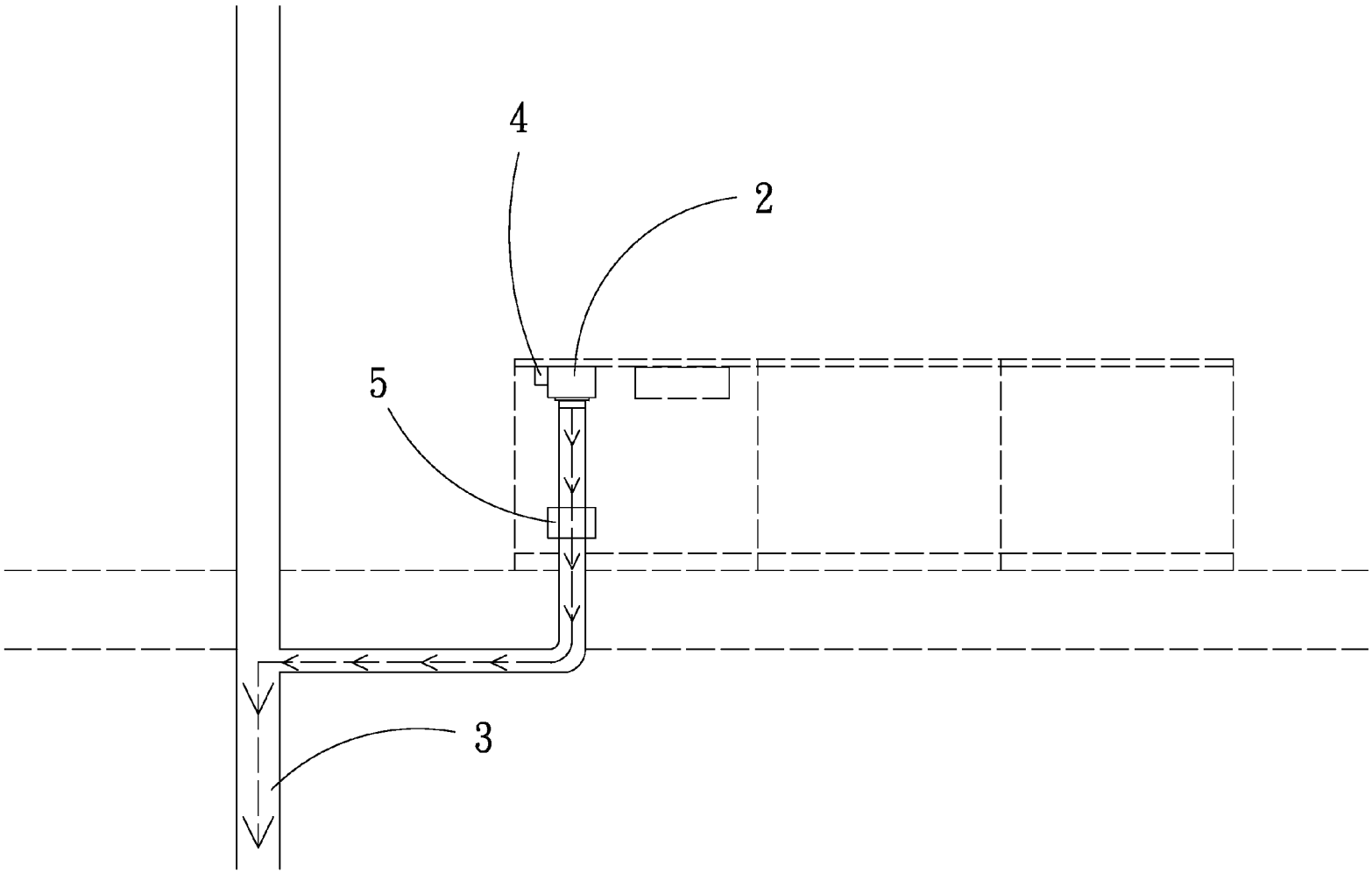
FIG. 6 is a partial schematic view of the preferred embodiment of the present invention.
Figure 7:
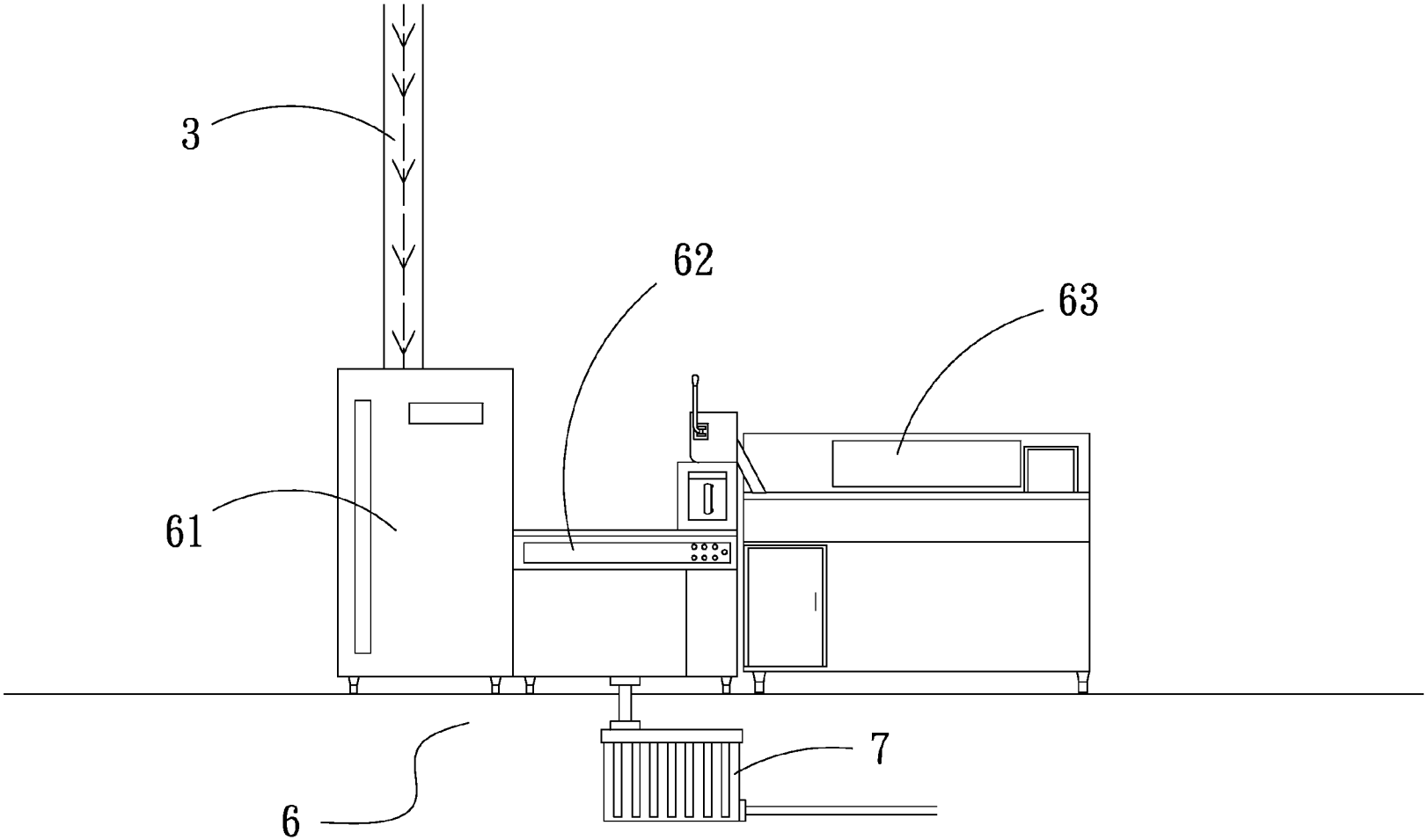
FIG. 7 is another partial schematic view of the preferred embodiment of the present invention.

Referring to FIGS. 1 through 3 for a schematic view and two partial schematic views of an apparatus 1 for collecting, processing, and recycling kitchen scraps according to the present invention, the apparatus 1 essentially includes at least one throw-in conduit 2, a delivery conduit 3, at least one flushing device 4, a kitchen scraps collection device 6, and a grease interception device 7.

Each throw-in conduit 2 is provided and extended on a certain floor of a building so that kitchen scraps can be thrown into each throw-in conduit 2. Each throw-in conduit 2 is additionally provided with a shredder 5 for shredding kitchen scraps thrown into the corresponding throw-in conduit 2.

The delivery conduit 3 is connected with a distal end of each throw-in conduit 2 and configured for delivering kitchen scraps thrown into each throw-in conduit 2.

Each flushing device 4 is provided at an end of a corresponding throw-in conduit 2 and is actuated manually, via automatic sensing, or intermittently so as to provide a flushing function.

The kitchen scraps collection device 6 is connected to a distal end of the delivery conduit 3 and configured for collecting and processing kitchen scraps thrown into each throw-in conduit 2. The kitchen scraps collection device mainly includes a storage tank 61, a shredding and dewatering device 62, and a fermentative conversion device 63.

The grease interception device 7 is connected to the kitchen scraps collection device 6. The grease interception device 7, for example, can be the 200L Grease Interceptor of Taiwan K.B.L. Corp.; the 8A Grease Interceptor of Chien-Chan Technology Corp., Taiwan; the 1103017 Grease Interceptor of Da Wel Long Enterprise Co., Taiwan; or the OS-005~OS-100 Grease Interceptor of Bi-Best Engineering Co., Taiwan. The above-listed models are for illustrative purposes only. The processing capacity as well as the operation mode and control method of the grease interception device 7 may vary according to practical needs.

Please refer to FIGS. 4 through 7 for a preferred embodiment of the present invention. As shown in the drawings, fruit peels or kitchen scraps generated after a meal are thrown into the throw-in conduit 2 mounted on a kitchen counter. The shredder 5, which is installed at a connecting portion between the throw-in conduit 2 and the delivery conduit 3, then shreds the peels or kitchen scraps. The shredded peels or kitchen scraps are flushed along with water into the delivery conduit 3 by means of the flushing device 4, thus allowing the delivery conduit 3 to deliver the shredded peels or kitchen scraps to the kitchen scraps collection device 6 connected to the distal end of the delivery conduit 3. The water provided by the flushing device 4 helps prevent the shredded peels or kitchen scraps from remaining in the delivery conduit 3 and consequently keeps the delivery conduit 3 clean. The peels or kitchen scraps are further shredded and dewatered in the storage tank 61 and the shredding and dewatering device 62 of the kitchen scraps collection device 6 and stored in the fermentative conversion device 63 so as to become organic fertilizer after fermentation.

The grease interception device 7 is connected to the shredding and dewatering device 62 of the kitchen scraps collection device 6. After the peels or kitchen scraps are shredded and dewatered by the shredding and dewatering device 62, the liquid removed from the peels or kitchen scraps is processed by the grease interception device 7 so that water and oil in the liquid are separated. Thus, the processing of kitchen scraps in a community is automated to the benefit of environmental protection.

While the present invention is herein described by reference to the preferred embodiment, it is understood that the embodiment is not intended to limit the scope of the present invention. All equivalent structures which are based on the contents disclosed in the present specification and the accompanying drawings and are applied directly or indirectly to other related fields should be encompassed by the appended claims.

What is claimed is:

1. An apparatus for collecting, processing, and recycling kitchen scraps, essentially comprising:

at least a throw-in conduit provided and extended on each floor of a building so that kitchen scraps can be thrown into each said throw-in conduit;

at least a delivery conduit connected to a distal end of each said throw-in conduit and configured for delivering kitchen scraps thrown into each said throw-in conduit;

at least a flushing device provided at an end of each said throw-in conduit;

a kitchen scraps collection device connected to a distal end of each said delivery conduit; and a grease interception device connected to the kitchen scraps collection device;

wherein kitchen scraps thrown into the throw-in conduit on each said floor of the building are transferred to a corresponding said delivery conduit by a corresponding said flushing device so as to reach the kitchen scraps collection device and the grease interception device and be processed thereby;

wherein each said throw-in conduit is provided with a shredder for shredding kitchen scraps thrown into the each said throw-in conduit and thus facilitating discharge of the kitchen scraps through a corresponding said delivery conduit;

wherein each said flushing device is actuated manually, via automatic sensing, or intermittently so as to provide a flushing function;

wherein the kitchen scraps collection device comprises a storage tank, a shredding and dewatering device, and a fermentative conversion device.

* * * * *